US007278710B2

(12) United States Patent
Hirota et al.

(10) Patent No.: US 7,278,710 B2
(45) Date of Patent: Oct. 9, 2007

(54) INKJET HEAD

(75) Inventors: Atsushi Hirota, Nagoya (JP); Hidetoshi Watanabe, Tokoname (JP); Tadanobu Chikamoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 75 days.

(21) Appl. No.: 11/016,732

(22) Filed: Dec. 21, 2004

(65) Prior Publication Data

US 2005/0140754 A1 Jun. 30, 2005

(30) Foreign Application Priority Data

Dec. 25, 2003 (JP) ..... 2003-429006

(51) Int. Cl.
*B41J 2/175* (2006.01)

(52) U.S. Cl. ..... 347/54; 347/85; 347/94

(58) Field of Classification Search ..... 347/54, 347/68–72, 94, 85
See application file for complete search history.

(56) References Cited

U.S. PATENT DOCUMENTS

| | | | | |
|---|---|---|---|---|
| 5,943,079 | A | 8/1999 | Yoshida | |
| 6,692,109 | B2 * | 2/2004 | Hirota et al. | 347/54 |
| 6,719,404 | B2 * | 4/2004 | Kobayashi | 347/54 |
| 6,830,325 | B2 * | 12/2004 | Hirota et al. | 347/94 |
| 2003/0058310 | A1 | 3/2003 | Murai | |

FOREIGN PATENT DOCUMENTS

| | | |
|---|---|---|
| EP | 0 759 361 A2 | 2/1997 |
| EP | 1 336 486 A2 | 8/2003 |
| JP | A 5-201015 | 8/1993 |
| JP | A 6-115092 | 4/1994 |
| JP | A 9-141856 | 6/1997 |
| JP | A 11-70673 | 3/1999 |
| JP | A 2000-52553 | 2/2000 |
| JP | A 2001-287361 | 10/2001 |
| JP | A 2002-19109 | 1/2002 |
| JP | A 2002-086721 | 3/2002 |
| JP | A 2003-11356 | 1/2003 |
| JP | A 2003-145761 | 5/2003 |

OTHER PUBLICATIONS

Japanese Office Action for Application No. 2003-429006; Sep. 5, 2006 with English Translation.

* cited by examiner

*Primary Examiner*—Huan Tran
(74) *Attorney, Agent, or Firm*—Oliff & Berridge, PLC

(57) ABSTRACT

A reservoir unit of an inkjet head has a plurality of laminated reservoir plates that forms an ink supply channel, and a flexible film that absorbs a fluctuation of pressure of ink in an ink reservoir. The flexible film is provided between adjacent two reservoir plates of the laminated plates. The adjacent two reservoir plates forms the ink reservoir. The flexible film partitions the ink reservoir into a first space to be filled with ink and a second space to be filled with no ink.

10 Claims, 10 Drawing Sheets

INKJET HEAD

BACKGROUND OF THE INVENTION

1. Filed of the Invention

The present invention relates to an inkjet head of in inkjet recording apparatus, which ejects ink onto a recording medium to perform printing thereon.

2. Description of the Related Art

In inkjet heads, ink supplied from an ink tank is distributed from a common ink chamber to a plurality of pressure chambers, and a pulsed pressure wave is applied selectively to each pressure chamber so as to eject ink from a nozzle communicating with the pressure chamber. Of such inkjet heads, some have an ink reservoir for reserving ink supplied from the ink tank and supplying the reserved ink to the plurality of pressure chambers in order to supply ink to the pressure chambers stably.

In an ink channel from the ink tank to each nozzle through the ink reservoir, each pressure chamber, etc., there occurs a fluctuation of ink pressure due to a water hammer phenomenon etc. caused by ink inertia when the ink is supplied from the ink tank. In this event, in spite of a pulsed pressure wave applied to the pressure chamber at predetermined timing, there is a case that ink cannot be ejected normally from the nozzle due to the influence of the fluctuation of pressure in the channel. In such a case, the accuracy of ink ejection is lowered. Therefore, an inkjet head having a pressure fluctuation absorbing unit for suppressing the aforementioned fluctuation of pressure has been proposed.

For example, there is an inkjet head in which a flexible sealing film for sealing an opening portion of an ink reservoir is provided in an upper end portion of the ink reservoir communicating with a common ink chamber (for example, see JP-A-2003-145761 (Page 6, FIGS. 1 and 2)). In this inkjet head, the surface of the sealing film on the opposite side to the ink reservoir is exposed to the outside in the position of the opening portion of the ink reservoir. Accordingly, the sealing film can be deformed so that the fluctuation of ink pressure in the ink reservoir can be absorbed by the deformation of the sealing film.

There is also an inkjet head in which a diaphragm is provided to define a common ink chamber communicating with pressure chambers and a damper chamber and to attenuate oscillation of ink pressure in the common ink chamber in order to absorb pressure waves (backward components) propagating from the pressure chambers to a manifold when a pulsed pressure is applied to the pressure chambers (for example, see Japanese Patent Laid-Open No. 141856/1998 (FIG. 1)).

SUMMARY OF THE INVENTION

However, when the sealing film is exposed to the outside as in the inkjet head disclosed in JP-A-2003-145761, there is a fear that the flexible sealing film which is weak in strength is broken by impact or the like acting thereon externally. On the other hand, the diaphragm in the inkjet head disclosed in Japanese Patent Laid-Open No. 141856/1998 is to simply absorb the backward components of the pressure waves propagating from the pressure chambers to the common ink chamber at the time of ink ejection. The common ink chamber provided with the diaphragm is close to the nozzles at the ends of ink channels, and is smaller in area than a channel upstream portion which has not yet branched to the pressure chambers. Accordingly, the area with which the diaphragm contacts with ink is so small that it is difficult for the deformation of the diaphragm to satisfactorily absorb a large fluctuation of pressure occurring at the time of ink supply.

It is an object of the invention to provide an inkjet head in which a fluctuation of pressure occurring in an wink channel at the time of ink supply can be absorbed surely, and a flexible film that absorbs the fluctuation of pressure is hardly broken.

According to one aspect of the invention, there is provided with an inkjet head including: a channel unit including; a common ink chamber extending in a plane; and a plurality of individual ink channels extending from the common ink chamber to nozzles through pressure chambers respectively; and a reservoir unit configured by a plurality of laminated plates and fixed to the channel unit, the reservoir unit including; an ink inlet that takes in ink supplied from outside; an ink reservoir that have a first space to be filled with ink and a second space to be filled with no ink; an ink supply channel extending from the ink inlet to the common ink chamber through the ink reservoir; and a flexible film provided between adjacent two plates of the laminated plates, that partitions the ink reservoir into the first space and the second space, wherein the flexible film absorbs fluctuation of pressure of the ink in the ink reservoir.

Ink supplied from the ink inlet is once reserved in the ink reservoir, and then supplied from the ink reservoir to the common ink chamber. Further, the ink is supplied from the common ink chamber to the nozzles through the individual ink channels respectively. Thus, the ink is ejected from the nozzles. Here, the reservoir unit has a plurality of laminated plates forming an ink supply channel extending from the ink inlet to the common ink chamber through the ink reservoir. The plurality of plates include a plurality of plates forming the ink reservoir. The flexible film for absorbing the fluctuation of ink pressure which may occur when ink is supplied into the ink reservoir is provided between two plates laminated to each other and included in the plurality of plates forming the ink reservoir. Further, by the flexible film, the ink reservoir is partitioned into a first space to be filled with ink and a second space to be filled with no ink. The second space serves to deform the flexible film.

The volume (area) of the ink reservoir is set to be wider than any other portion of the ink supply channel because the ink reservoir can once reserve ink. In addition, the flexible film for absorbing the ink pressure is provided in the ink reservoir. Accordingly, the effect of absorbing the fluctuation of pressure due to the flexible film is enhanced. Thus, the fluctuation of ink pressure occurring due to ink supply into the ink reservoir or the like can be attenuated quickly. In addition, since the flexible film is provided in the ink reservoir and is not exposed to the outside, the flexible film is hardly broken even when external impact or the like acts on the reservoir unit for some reason.

According to another aspect of the invention, the flexible film has a first ink pass hole that is provided in a region of the flexible film opposed to the first space, and the first ink pass hole communicates the first space to the ink supply channel.

Thus, the reservoir unit can be made smaller in size than in the case where ink flows into the ink reservoir from a direction parallel to the planes of the laminated plates.

According to another aspect of the invention, one of the two plates has a first space formation hole that forms the first space of the ink reservoir, the other of the two plates has a second space formation hole that forms the second space of the ink reservoir, and a second ink pass hole that is provided in a region opposed to the first space and separated from the second space formation hole, and the second ink pass hole communicates the first space to the ink supply channel through the first ink pass hole. The ink flowing through the ink supply channel flows into the first space formed in one of the two plates, through the second ink pass hole formed in the other of the two plates and the first ink pass hole formed in the flexible film. Here, in the other of the two plates, the second ink pass hole is formed in a position separated from the second space formation hole forming the second space. Further, the second ink pass hole is formed discontinuously to the second space formation hole so that the second ink pass hole does not communicate with the second space formation hole. Therefore, there is no fear that ink flows into the second space. Accordingly, the flexible film can be deformed surely by the second space filled with no ink. When there occurs a fluctuation of pressure in the ink reservoir, the fluctuation of pressure is absorbed by the deformation of the flexible film.

According to another aspect of the invention, the other of the two plates has a plurality of second space formation holes on the surfaces, and the second ink pass hole is formed in the region between the two second space formation holes. Since the second ink pass hole is formed between the two second space formation holes thus, the second space formation holes and the second ink pass hole can be disposed efficiently within one plane. Thus, the reservoir unit can be miniaturized.

According to another aspect of the invention, the other of the two plates further includes a recess portion formed in a region opposed to the first space, the recess portion makes the second space formation holes communicative with each other.

Since the two space formation holes are made to communicate with each other through the recess portion, of the flexible film, portions opposed to the two second space formation holes can be vibrated integrally. Thus, the fluctuation of pressure can be absorbed more efficiently.

According to another aspect of the invention, the ink reservoir further includes an atmosphere communication hole that makes communication between the second space formation hole and an outside of the reservoir unit. Accordingly, the flexible film is hardly affected by the internal pressure of the air in the second space. Thus, the fluctuation of pressure can be absorbed more efficiently.

According to another aspect of the invention, the first ink pass hole is formed in a center of the flexible film, and the second ink pass hole is formed in a surface, that faces the flexible film, of the other of two plates.

According to another aspect of the invention, the second space is provided on an upper side of the first space.

According to another aspect of the invention, the first space of the ink reservoir and the second space of the ink reservoir substantially have a same size in a cross section, when viewed from a laminated direction of the plates.

According to another aspect of the invention, the atmosphere communication hole is provided with the other of two plates, and the atmosphere communication hole communicates with outside from a side face of the reservoir unit.

DESCRIPTION OF THE PREFERRED EMBODIMENTS

Figure 1:
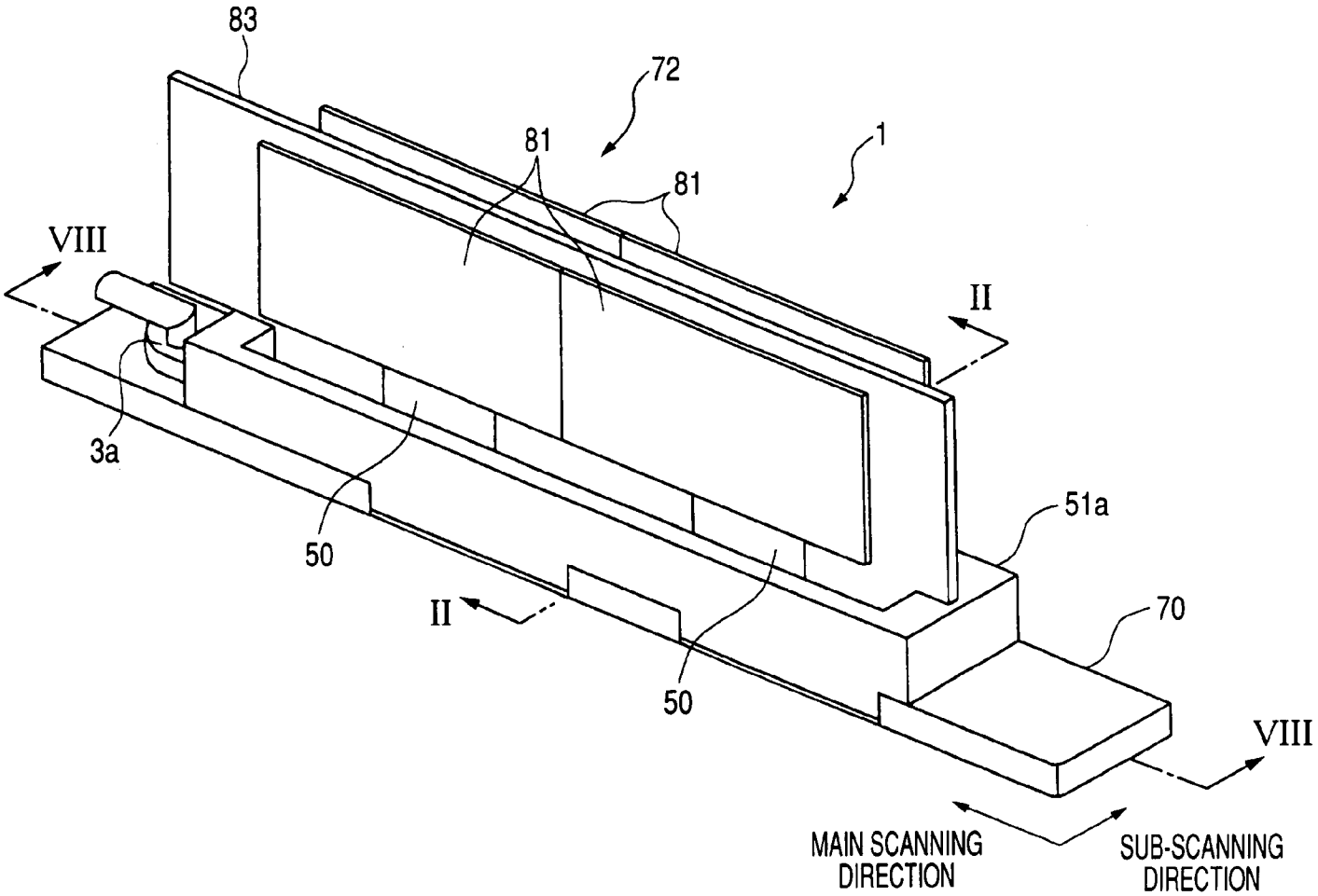
FIG. 1 is a perspective view of an inkjet head according to an embodiment of the invention.
Figure 2:
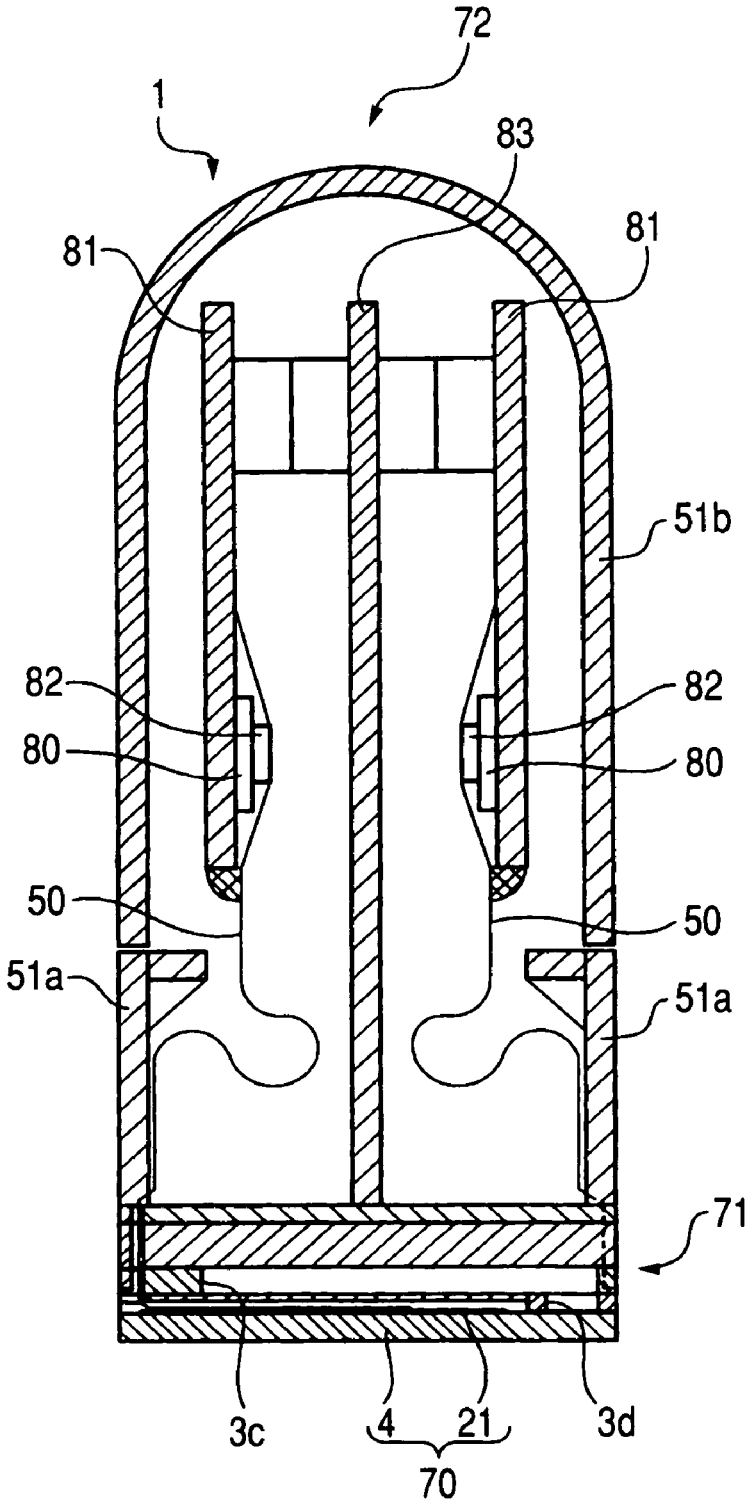
FIG. 2 is a sectional view taken on line II-II in FIG. 1.

An embodiment of the invention will be described with reference to the drawings. As shown in FIGS. 1 and 2, an inkjet head 1 has a head body 70, a reservoir unit 71, a head control portion 72, a lower cover 51*a* and an upper cover 51*b*. The head body 70 extends in a main scanning direction for ejecting ink onto paper. The head body 70 has a rectangular planar shape. The reservoir unit 71 is disposed on the top of the head body 70. In the reservoir unit 71, an ink reservoir 3*c* for reserving ink to be supplied to the head body 70 is formed. The head control portion 72 is disposed above the reservoir unit 71 and for controlling the head body 70. The lower cover 51*a* and the upper cover 51*b* are provided for protecting the inside of the inkjet head 1 from ink droplets. Incidentally, in FIG. 1, as a matter of convenience in explanation, the upper cover 51*b* is not shown.

The head body 70 includes a channel unit 4 in which ink channels are formed, and a plurality of actuator units 21 bonded to the upper surface of the channel unit 4. The channel unit 4 and the actuator units 21 have a laminated structure in which a plurality of thin sheets are laminated and bonded to one another.

The reservoir unit 71 is provided so that ink supplied from an ink inlet 3*a* is reserved in an ink reservoir 3*c*, and the reserved ink is supplied to the channel unit 4. The planar shape of the reservoir unit 71 is substantially the same as the planar shape of the channel unit 4. Ink outflow channels 3*d* are formed in a lower end portion of the reservoir unit 71 so as to project downward. The reservoir unit 71 and the channel unit 4 are connected only in lower end opening portions of the ink outflow channels 3*d*. Any region of the reservoir unit 71 other than the ink outflow channels 3*d* in plan view is separated upward from the head body 70. The actuator units 21 are disposed in a clearance with which the reservoir unit 71 is separated from the head body 70. In addition, flexible printed circuits (FPCs) 50 serving as feeder members are electrically connected to the upper surfaces of the actuator units 21 respectively. The FPCs 50 are extracted from the sub-scanning-direction opposite sides of the actuator units 21 to the outside of the actuator units 21.

Figure 4:
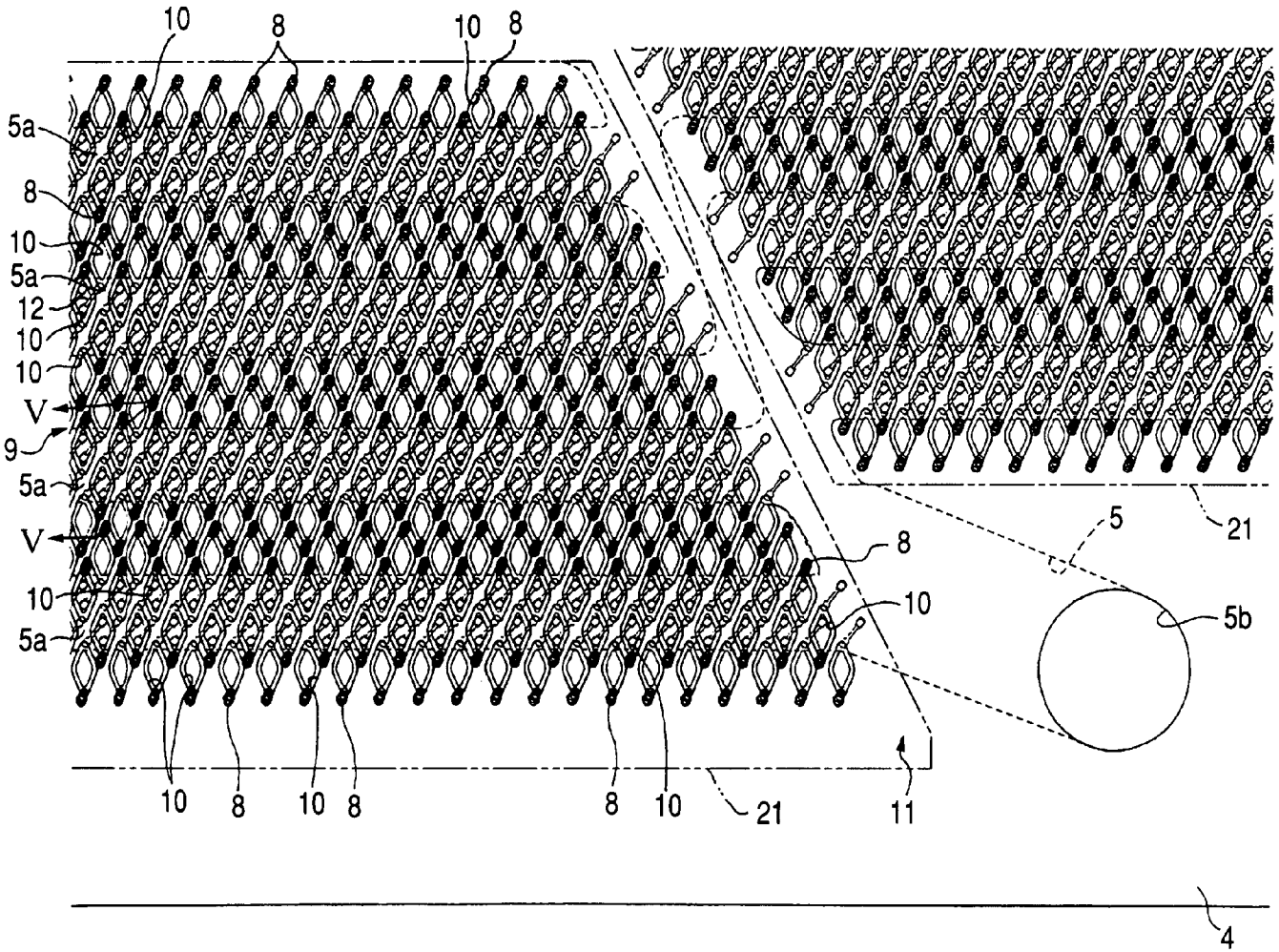
FIG. 4 is an enlarged view of a region surrounded with the one-dot chain line in FIG. 3.
Figure 5:
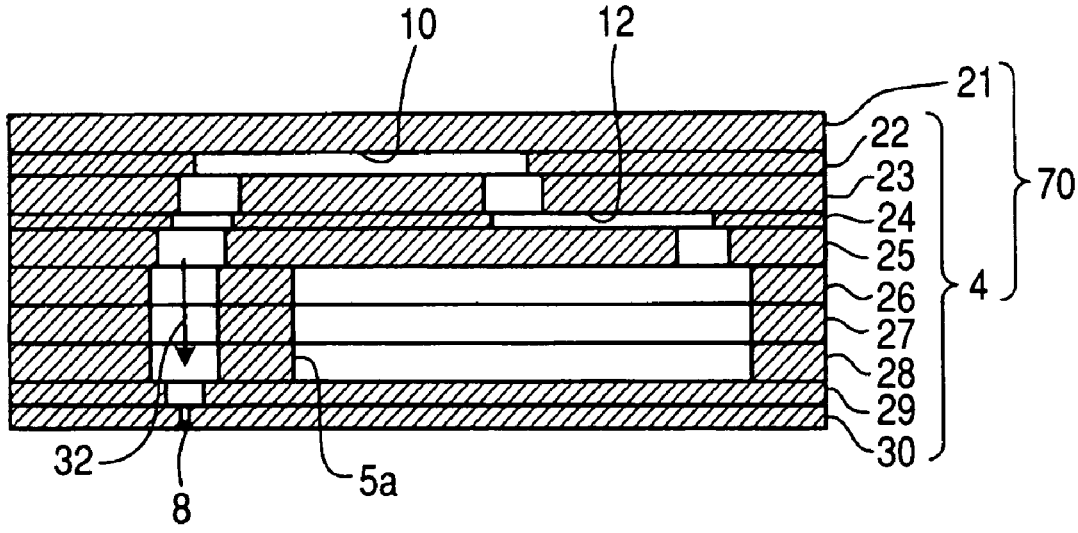
FIG. 5 is a sectional view taken on line V-V in FIG. 4.

The head control portion 72 is to control various operations of the inkjet head 1, such as ink ejection from nozzles 8 (see FIGS. 4 and 5). The head control portion 72 includes a main board 83, sub-boards 81 and driver ICs 80. The main board 83 has a rectangular shape extending in the main scanning direction. The main board 83 is provided erectly on the top of the reservoir unit 71. The sub-boards 81 are disposed on the opposite sides of the main board 83 and in parallel to the main board 83. The sub-boards 81 are electrically connected to the main board 83. The driver ICs 80 are to generate signals for driving the actuator units 21. The driver ICs 80 are fixed to the main board 83 side surfaces of the sub-boards 81 together with heat sinks 82 provided on the driver ICs 80 respectively. The sub-boards 81 and the driver ICs 80 ate electrically connected to the FPCs 50 extracted from the sub-scanning-direction opposite sides of the actuator units 21, respectively. The FPCs 50 are electrically connected to the sub-boards 81 and the driver ICs 80 so as to transmit signals output from the sub-boards 81 to the driver ICs 80 and transmit driving signals output from the driver ICs 80 to the actuator units 21 of the head body 70.

The lower cover 51*a* is a substantially quadrilateral cylindrical housing. The lower cover 51*a* is disposed on the head body 70 so that the FPCs 50 extracted above the reservoir unit 71 are covered therewith from outside. Above the actuator units 21, the FPCs 50 are received in the lower cover 51*a* so that the FPCs 50 are slack enough to prevent stress from being applied thereto.

The upper cover 51*b* is an angled housing having an arched ceiling. The upper cover 51*b* is disposed on the upper side of the lower cover 51*a* so that the main board 83 and the sub-boards 81 are covered with the upper cover 51*b* from outside. When the lower cover 51*a* and the upper cover 51*b* are placed, the sub-scanning-direction width of the lower cover 51*a* and the upper cover 51*b* is settled within the sub-scanning-direction width of the head body 70.

Figure 3:
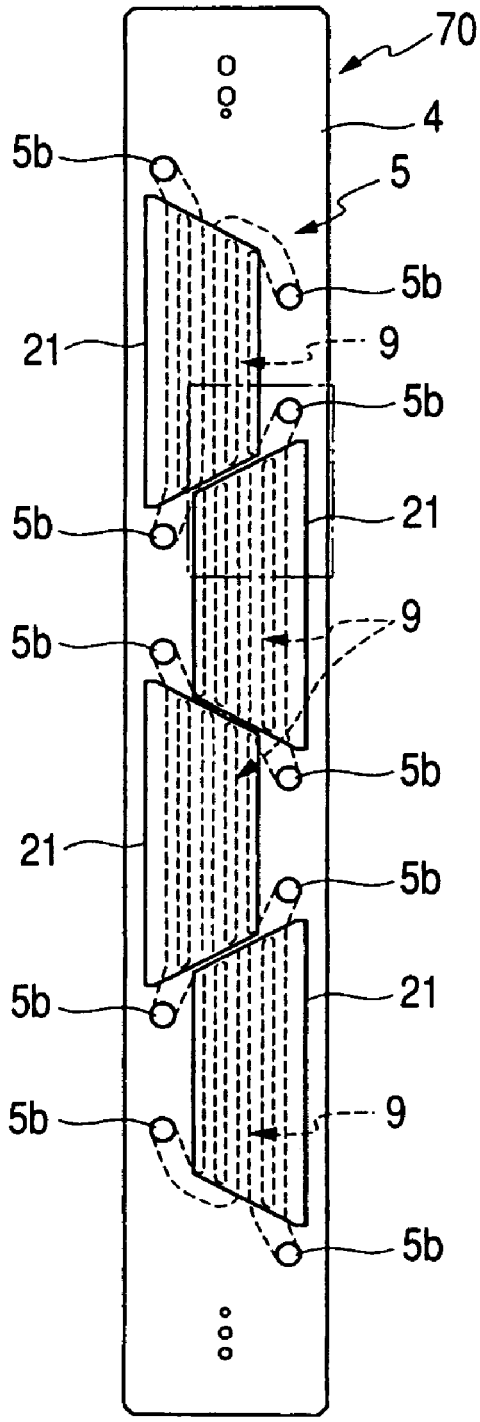
FIG. 3 is a plan view of a head body.

Next, detailed description will be made about the structure of the head body 70. FIG. 3 is a plan view of the head body 70 shown in FIG. 1. FIG. 4 is an enlarged plan view of the region surrounded with the one-dot chain line in FIG. 3. As shown in FIGS. 3 and 4, the head body 70 includes a channel unit 4 in which a large number of pressure chambers 10 constituting pressure chamber groups 9 and a large number of nozzles 8 are formed. A plurality of trapezoidal actuator units 21 arrayed zigzag in two lines are bonded to the top of the channel unit 4. In particular, each actuator unit 21 is disposed so that its parallel opposite sides (upper and lower sides) extend in the longitudinal direction of the channel unit 4. Oblique sides of adjacent ones of the actuator units 21 overlap each other in the width direction of the channel unit 4.

The lower surface of the channel unit 4 opposite to the bonded region of each actuator unit 21 serves as an ink ejection region. As shown in FIG. 4, in the surface of the ink ejection region, a large number of nozzles 8 are arrayed in a matrix. The pressure chambers 10 each communicating with one of the nozzles 8 are also formed in a matrix. A plurality of pressure chambers 10 located in the lower surface of the channel unit 4 opposed to the bonded region of each actuator unit 21 form one pressure chamber group 9.

Each nozzle 8 is a tapered nozzle, which communicates with a sub-manifold 5*a* through a pressure chamber 10 having a rhomboid shape in plan view, and an aperture 12. The sub-manifold 5*a* is a branch channel of a manifold 5 serving as a common ink chamber. Opening portions 5*b* of the manifold 5 provided in the upper surface of the channel unit 4 are connected to the ink outflow channels 3*d* provided in the lower surface of the reservoir unit 71. Thus, ink is supplied from the reservoir unit 71 to the channel unit 4 through the ink outflow channels 3*d*. Incidentally, in FIG. 4, the pressure chambers 10 (pressure chamber groups 9), the opening portions 5*b*, the apertures 12, etc. which should be depicted by broken lines because they are under the actuator units 21 are depicted by solid lines in order to making the drawing understood easily.

Next, description will be made about the sectional structure of the head body 70. As shown in FIG. 5, each nozzle 8 communicates with a corresponding sub-manifold 5*a* through a corresponding pressure chamber 10 and a corresponding aperture 12. In the head body 70, an individual ink channel 32 is formed thus for each pressure chamber 10 so as to extend from the outlet of the sub-manifold 5*a* to the nozzle 8 through the aperture 12 and the pressure chamber 10.

Figure 6:
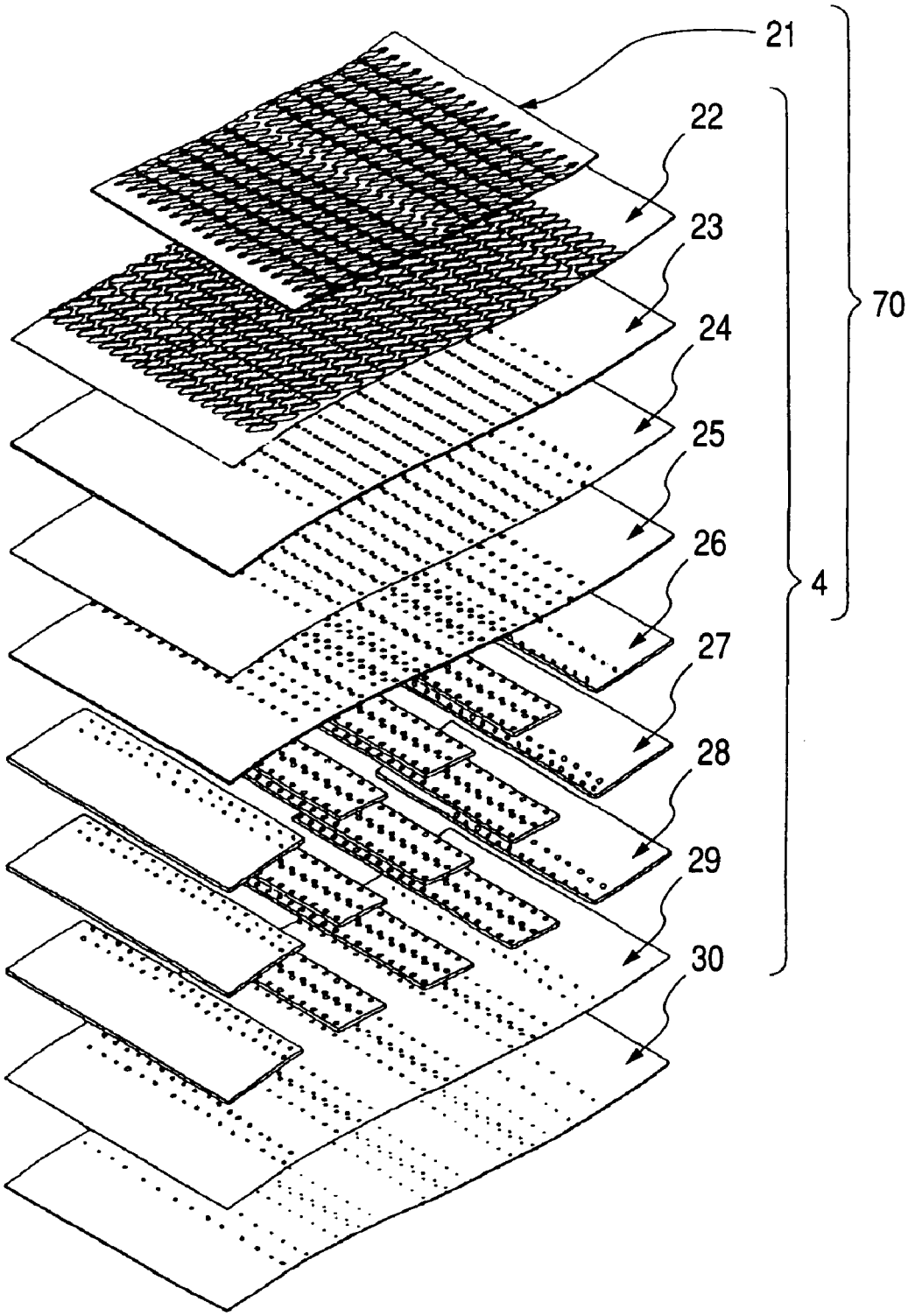
FIG. 6 is a partially exploded perspective view of the head body.

As shown in FIG. 6, the head body 70 has a laminated structure in which a total of 10 sheet materials of the actuator units 21, a cavity plate 22, a base plate 23, an aperture plate 24, a supply plate 25, manifold plates 26, 27 and 28, a cover plate 29 and a nozzle plate 30 are laminated in descending order.

Of those sheet materials, the nine metal plates excluding the plate of the actuator units 21 constitute the channel unit 4.

In each actuator unit 21, four piezoelectric sheets 41-44 (see FIGS. 7A and 7B) are laminated, and electrodes are disposed, as will be described in detail later. Of the piezoelectric sheets 41-44, only the uppermost layer is set as a layer (hereinafter simply referred to as "layer having an active portion") having a portion serving as an active layer when an electric field is applied thereto. The other three layers are set as inactive layers. The cavity plate 22 is a metal plate provided with a large number of rhomboid openings corresponding to the pressure chambers 10. The base plate 23 is a metal plate in which for each pressure chamber 10 of the cavity plate 22, a communication hole between the pressure chamber 10 and the aperture 12 and a communication hole between the pressure chamber 10 and the nozzle 8 are provided. The aperture plate 24 is a metal plate in which for each pressure chamber 10 of the cavity plate 22, a communication hole between the pressure chamber 10 and the nozzle 8 is provided in addition to the aperture 12 formed by two holes and a half-etched region connecting the two holes with each other. The supply plate 25 is a metal plate in which for each pressure chamber 10 of the cavity plate 22, a communication hole between the aperture 12 and the sub-manifold channel 5*a* and a communication hole between the pressure chamber 10 and the nozzle 8 are provided. The manifold plates 26, 27 and 28 are metal plates in which for each pressure chamber 10 of the cavity plate 22, a communication hole between the pressure chamber 10 and the nozzle 8 is provided in addition to holes which are connected with one another to thereby form the sub-manifolds 5*a* when the plates are laminated. The cover plate 29 is a metal plate in which for each pressure chamber 10 of the cavity plate 22, a communication hole between the pressure chamber 10 and the nozzle 8 is provided. The nozzle plate 30 is a metal plate in which a nozzle 8 is provided for each pressure chamber 10 of the cavity plate 22.

The nine metal plates are aligned and laminated to one another so that the individual ink channels 32 are formed as shown in FIG. 5. Each individual ink channel 32 first leaves upward from the sub-manifold channel 5*a* and extends horizontally in the aperture 12. Then the individual ink channel 32 goes upward again and extends horizontally in the pressure chamber 10 again. After that, the individual ink channel 32 turns obliquely downward so as to leave the aperture 12 for a while, and then turns vertically downward so as to approach the nozzle 8.

Figure 7A:
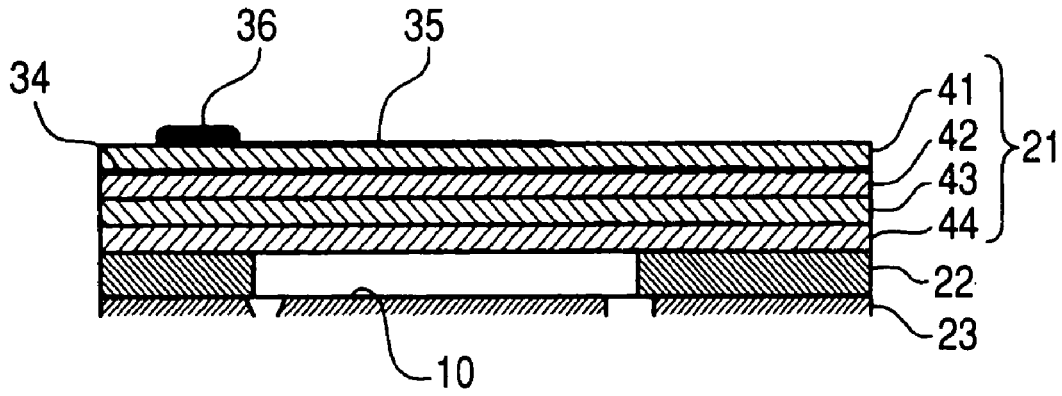
FIG. 7A is a partially enlarged sectional view of an actuator unit.
Figure 7B:
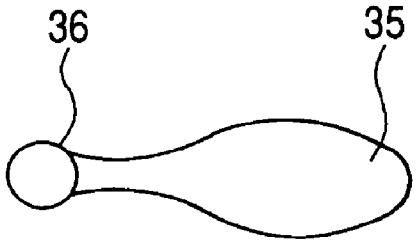
FIG. 7B is a plan view of an individual electrode.

Next, description will be made about the configuration of each actuator unit 21 laminated to the cavity plate 22 which is the uppermost layer of the channel unit 4. FIG. 7A is a partially enlarged sectional view of an actuator unit 21 and a pressure chamber 10. FIG. 7B is a plan view of an individual electrode bonded to the surface of the actuator unit 21.

As shown in FIG. 7A, the actuator unit 21 includes four piezoelectric sheets 41, 42, 43 and 44 formed to have one and the same thickness of about 15 μm. The piezoelectric sheets 41-44 are formed as continuous lamellar flat plates (continuous flat plate layers) to be disposed over a large number of pressure chambers 10 formed within one ink ejection region in the head body 70. When the piezoelectric sheets 41-44 are disposed as continuous flat plate layers over a plurality of pressure chambers 10, individual electrodes 35 can be disposed on the piezoelectric sheet 41 with high density, for example, by use of a screen printing technique. Accordingly, the pressure chambers 10 to be formed in positions corresponding to the individual electrodes 35 can be also disposed with high density. Thus, high-resolution images can be printed. The piezoelectric sheets 41-44 are made of a lead zirconate titanate (PZT) based ceramics material having ferroelectricity.

The individual electrodes 35 are formed on the piezoelectric sheet 41 which is the uppermost layer. A common electrode 34 about 2 μm thick is put between the piezoelectric sheet 41 which is the uppermost layer and the piezoelectric sheet 42 which is under the piezoelectric sheet 41, so as to be formed all over the surfaces of the sheets. Incidentally, no electrode is disposed between the piezoelectric sheet 42 and the piezoelectric sheet 43. The individual electrodes 35 and the common electrode 34 are made of a metal material such as an Ag—Pd based metal material.

Each individual electrode 35 is about 1 μm thick. As shown in FIG. 7B, each individual electrode 35 has a rhomboid planar shape which is substantially similar to the pressure chamber 10 shown in FIG. 4. One of acute angle portions in the rhomboid individual electrode 35 is extended and provided on its tip with a circular land portion 36 electrically connected to the individual electrode 35. The land portion 36 has a diameter of about 160 μm. The land portion 36 is, for example, made of gold containing glass frit. The land portion 36 is bonded onto the surface of an extended portion of the individual electrode 35 as shown in FIG. 7A. In addition, the land portion 36 is electrically connected to a contact point provided in the FPC 50.

The common electrode 34 is grounded in a not-shown region. Consequently, the common electrode 34 is kept in the ground potential equally over all the regions corresponding to all the pressure chambers 10. In addition, each individual electrode 35 is connected to the driver IC 80 through the FPC 50 and the land portion 36. The FPC 50 includes lead wires which are independent of one another in accordance with the individual electrodes 35 (see FIGS. 1 and 2). Thus, the potential of each individual electrode 35 can be controlled correspondingly to each pressure chamber 10.

Next, description will be made about a method for driving each actuator unit 21. The piezoelectric sheet 41 in the actuator unit 21 has a polarizing direction in the thickness direction thereof. That is, the actuator unit 21 has a so-called unimorph type configuration in which one piezoelectric sheet 41 on the upper side (that is, on the opposite side to the pressure chambers 10) is set as a layer where an active layer exists, while three piezoelectric sheets 41-43 on the lower side (that is, on the pressure chambers 10 side) are set as inactive layers. Accordingly, when the individual electrodes 35 are set at positive or negative predetermined potential, each electric-field-applied portion between electrodes in the piezoelectric sheet 41 will act as an active layer so as to contract in a direction perpendicular to the polarizing direction due to piezoelectric transversal effect, for example, if an electric field is applied in the same direction as the polarization. On the other hand, the piezoelectric sheets 42-44 are not affected by any electric field, and they do not contract voluntarily. Therefore, between the piezoelectric sheet 41 on the upper side and the piezoelectric sheets 42-44 on the lower side, there occurs a difference in strain in a direction perpendicular to the polarizing direction, so that the piezoelectric sheets 41-44 as a whole want to be deformed to be convex on the inactive side (unimorph deformation). In this event, as shown in FIG. 7A, the lower surface of the piezoelectric sheets 41-44 is fixed to the upper surface of the cavity plate 22 which defines the pressure chambers 10. Consequently, the piezoelectric sheets 41-44 are deformed to be convex on the pressure chamber 10 side. Accordingly, the volume of each pressure chamber 10 is reduced so that the pressure of ink in the pressure chamber 10 increases. Thus, the ink is ejected from the nozzle 8 communicating with the pressure chamber 10. After that, when the individual electrodes 35 are restored to the same potential as the common electrode 34, the piezoelectric sheets 41-44 are restored to their initial shapes so that the volume of each pressure chamber 10 is restored to its initial volume. Thus, the pressure chamber 10 sucks ink from the sub-manifold channel 5*a*.

Figure 8:
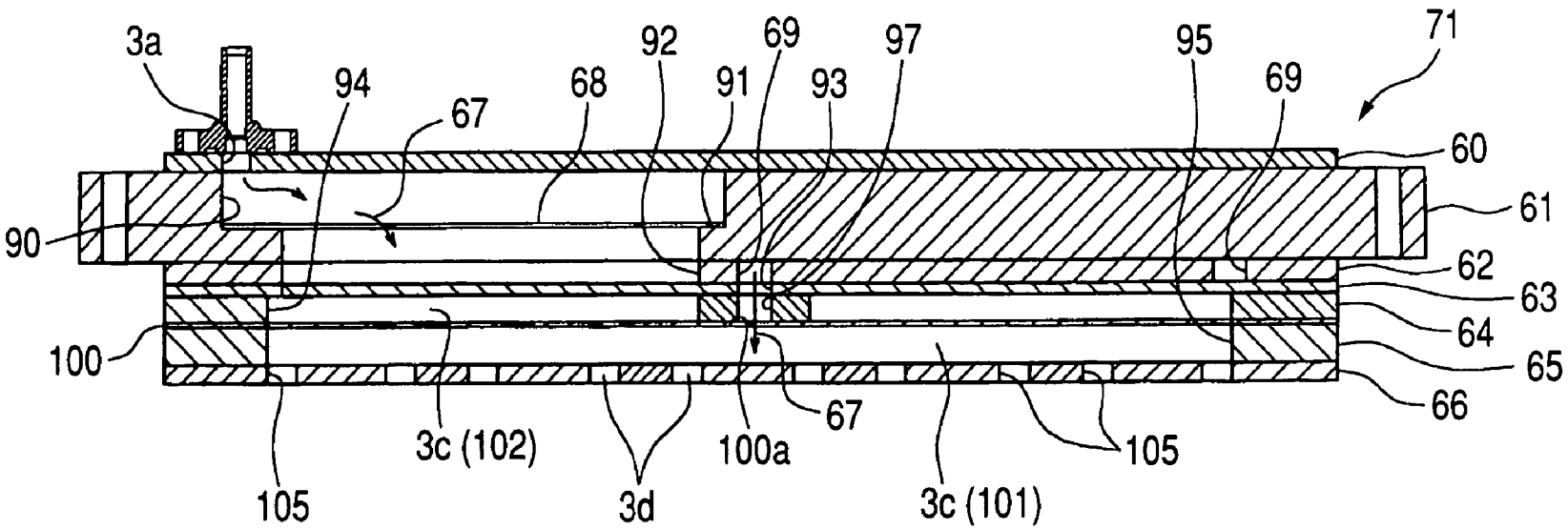
FIG. 8 is a sectional view taken on line VIII-VIII in FIG. 1.
Figure 9:
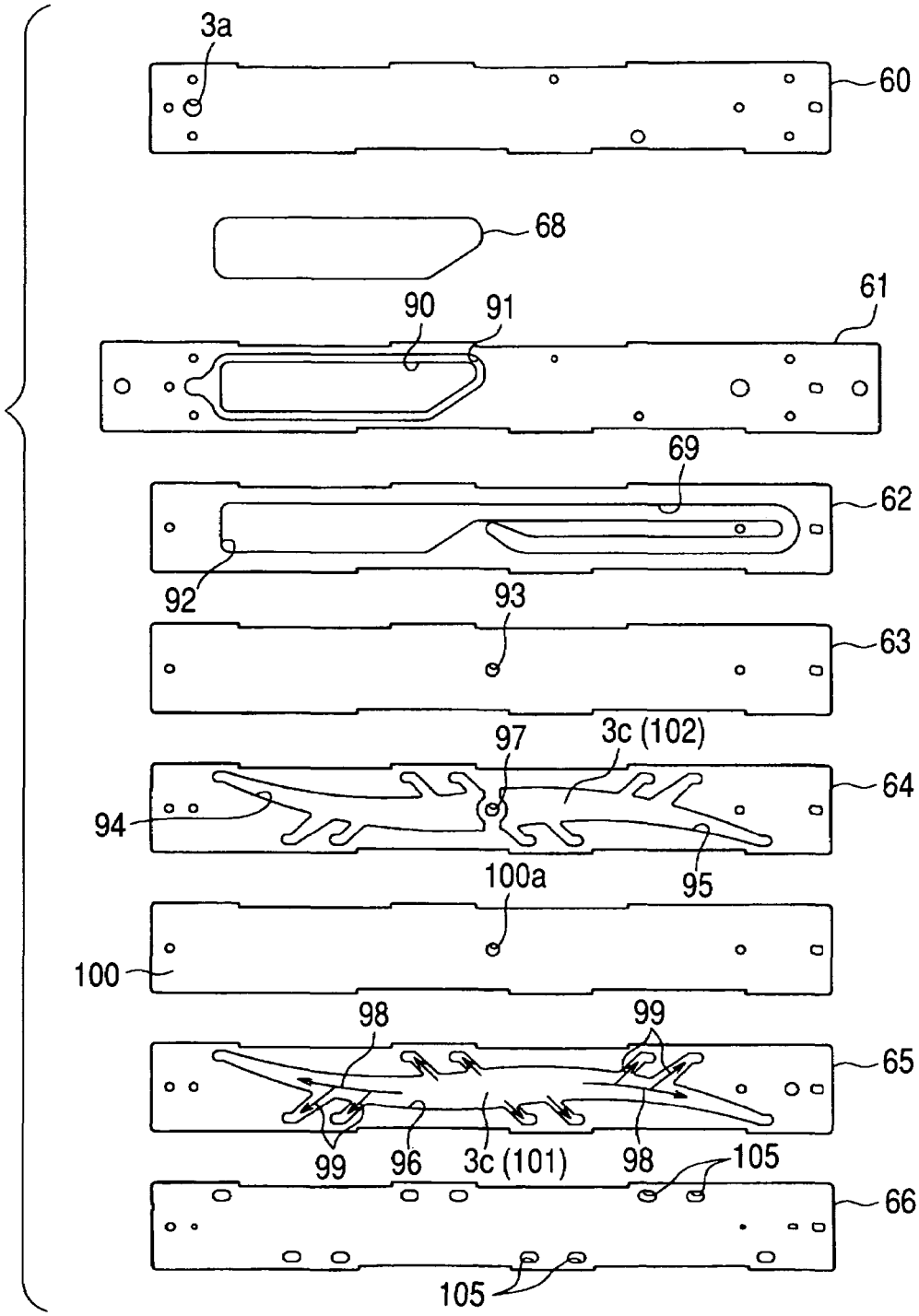
FIG. 9 is a plan view of respective plates forming a reservoir unit.

Next, detailed description will be made about the structure of the reservoir unit 71. As shown in FIGS. 8 and 9, the reservoir unit 71 has a structure in which seven plates of first to seventh reservoir plates 60 to 66 are laminated in turn in descending order so as to form an ink supply channel 67 extending from the ink inlet 3*a* to the manifold 5 through the ink reservoir 3*c*. Ink is supplied from the outside to the ink inlet 3*a*. Each reservoir plate 60-66 is a substantially rectangular metal plate extending in the main scanning direction. Of the seven plates of the first to seventh reservoir plates 60 to 66, four plates of the fourth to seventh reservoir plates 63 to 66 are plates for forming the ink reservoir 3*c*.

The ink inlet 3*a* to which ink is supplied from the outside is formed in a main-scanning direction end portion (left end portion in FIG. 8) of the first reservoir plate 60. In a left region of the second reservoir plate 61 in FIG. 9, a filter mounting hole 90 for mounting a filter 68 therein is formed as to communicate with the ink inlet 3*a*. A stepped filter support portion 91 is formed in an up/down direction midway portion of the filter mounting hole 90 in FIG. 8 so as to extend along the inner circumference of the filter mounting hole 90. The filter 68 is supported inside the filter mounting hole 90 by the filter support portion 91.

The filter 68 is to filter the ink in the ink supply channel 67 so as to prevent dust or the like from adhering to the nozzles 8, the pressure chambers 10 or the like on the downstream side. In order to prevent dust or the like from flowing downstream and closing the nozzles 8, the mesh size of the filter 68 is enough small in comparison with the nozzle diameter. In addition, in the filter 68, the resistance to filtration is lower in a portion closer to the right end in FIG. 8. Further, in this embodiment, the filter mounting hole 90 is formed to be tapered on the downstream of the ink flow so that the ink flowing on the filter 68 is introduced to the tip portion of the filter mounting hole 90. Accordingly, when the ink supplied from the ink inlet 3*a* located on the left side in FIG. 8 is flowing on the filter 68, dust or the like is filtered from the ink so that the clean ink can be sent downstream. Further, bubbles which may flow in from the outside together with the ink can be discharged to the outside without staying in the downstream portion of the region above the filter 68.

The third reservoir plate 62 includes a hole 92 formed in a position corresponding to the filter mounting hole 90 in plan view, and an ink sink channel 69 having a U-shape in plan view. The hole 92 is formed into a shape substantially similar to that of the filter mounting hole 90. The ink sink channel 69 extends horizontally from the tapered tip portion of the hole 92, and reaches an ink sink hole 93 of the ink reservoir 3*c*. The ink sink channel 69 extends from the hole 92 to the right in FIG. 8, U-turns near the right end in FIG. 8, and extends to the left so as to communicate with the ink sink hole 93 of the fourth ink reservoir plate 63.

Next, description will be made about the fourth to seventh reservoir plates 63 to 66 forming the ink reservoir 3*c*. The ink sink hole 93 for sinking ink into the ink reservoir 3*c* is formed in a substantially central position of the fourth reservoir plate 63 in plan view.

Two reservoir holes 94 and 95 extending two-dimensionally are formed respectively in regions separated on the opposite, left and right sides of the fifth reservoir plate 64. On the other hand, in the sixth reservoir plate 65, one reservoir hole 96 is formed to extend two-dimensionally in a position where the reservoir hole 96 overlaps the reservoir holes 94 and 95 in plan view. The reservoir hole 96 occupies a comparatively wide area of the whole area of the sixth reservoir plate 65 (for example, about ⅓ of the whole area). The fifth and sixth reservoir plates 64 and 65 are put between the fourth and seventh reservoir plates 63 and 67 so that the reservoir holes 94 to 96 are positioned on the opposite, upper and lower sides respectively. Thus, the ink reservoir 3*c* is formed.

As soon as ink is supplied into the ink supply channel 67 through the ink inlet 3*a*, for example, ink ejection from the nozzles 8 disposed on the downstream side of the individual ink channels 32 communicating with a specific manifold 5 may be suspended concurrently. In such a case, there occurs a fluctuation of ink pressure in the ink supply channel 67 due to a water hammer phenomenon caused by the ink inertia in spite of suspension of ink consumption which has made a comparatively large ink flow to the plurality of individual ink channels 32 till then. Here, in the inkjet head 1, as described previously, the pressure in each pressure chamber 10 is once lowered by each actuator unit 21, and next a pulsed pressure is applied to the pressure chamber so as to eject ink from the corresponding nozzle 8. However, when the ink is ejected from the nozzle 8, a fluctuation of pressure due to a water hammer phenomenon occurring in the ink supply channel 67 may be propagated into the individual ink channel 32. In such a case, there is a fear that ink cannot be ejected from the nozzle 8 at predetermined timing. In that case, the ink ejection accuracy deteriorates.

Therefore, in the inkjet head 1 according to this embodiment, a flexible film 100 for absorbing the fluctuation of ink pressure in the ink reservoir 3*c* is provided between the fifth and sixth reservoir plates 64 and 65 which are plates for forming the ink reservoir 3*c*. Further, by the flexible film 100, the ink reservoir 3*c* is partitioned into a lower-side first space 101 to be filled with ink and an upper-side second space 102 to be filled with no ink. The second space 102 serves to deform the flexible film 100. The first space 101 is formed by the reservoir hole 96 (first space formation hole) of the sixth reservoir plate 65. On the other hand, the second space 102 is formed by the two reservoir holes 94 and 95 (second space formation holes) of the fifth reservoir plate 64.

The flexible film 100 is, for example, made of synthetic resin such as polyimide. An ink pass hole 100*a* (first ink pass hole) forming a part of the aforementioned ink supply channel 67 is formed in a region of the flexible film 100 opposed to the first space 101 and overlapping the ink sink hole 93 in plan view. Accordingly, ink flowing in the ink supply channel 67 penetrates the flexible film 100 in the ink pass hole 100*a* and flows into the ink reservoir 3*c* (first space 101). Thus, the two-dimensional size of the reservoir unit 71 can be made smaller than that in the case where ink flows into the ink reservoir 3*c* from a direction parallel to the planes of the laminated plates without penetrating the flexible film 100.

In the embodiment of the invention, the ink sink hole 93, the ink pass hole 97, and the ink-pas hole 100*a* are formed in center of each plates (or film). When the ink sink hole 93, the ink pass hole 97, and the ink pas hole 100*a* are not formed in the center of each plate (or film), time to reach the ink from the ink sink hole to each branch channel 99 differs in each branch channel. Thus, air tends to be at the branch channel 99 to have much time to reach the ink, so that the air is not effectively discharged from the inkjet head.

However, in the embodiment, the time does not differ in each branch channel 99, so that the air is effectively discharged from the inkjet head.

An ink pass hole 97 (second ink pass hole) forming a part of the ink supply channel 67 and communicating with the ink pass hole 100*a* is formed in a position between the two reservoir holes 94 and 95 of the fifth reservoir plate 64. Here, the ink pass hole 97 is formed to be separated from the two reservoir holes 94 and 95 located on the opposite, left and right sides. Further, the ink pass hole 97 and the reservoir holes 94 and 95 are formed discontinuously in the fifth reservoir plate 64 so that they do not communicate with one another. Therefore, there is no fear that ink flows into the second space 102 formed by the reservoir holes 94 and 95. In addition, since the ink pass hole 97 is provided in a region between the two reservoir holes 94 and 95, the two reservoir holes 94 and 95 and the ink pass hole 97 can be disposed efficiently within one plane. Thus, the reservoir unit 71 can be miniaturized.

The ink passing through the filter 68 flows into the first space 101 of the ink reservoir 3*c* through the ink sink hole 93 of the fourth reservoir plate 63, the ink pass hole 97 of the fifth reservoir plate 64 and the ink pass hole 100*a* of the flexible film 100. In this event, the flexible film 100 disposed between the first space 101 and the second space 102 can be deformed by the second space 102 filled with no ink. The fluctuation of pressure caused by the water hammer phenomenon of the ink occurring in the first space 101 is absorbed by the deformation of the flexible film 100. In addition, since the second space 102 filled with no ink is disposed on the gravity-direction upper side of the first space 101 filled with ink, there is no fear that the weight of the ink acts on the flexible film 100. Thus, the degree of freedom in deformation of the flexible film 100 absorbing the fluctuation of pressure is enhanced.

The ink reservoir 3*c* branches to extend to positions where the branches overlap the opening portions 5*b* (see FIG. 3) of the manifold 5 of the channel unit 4 in plan view, respectively. In addition, the ink reservoir 3*c* has a planar shape which is symmetric with respect to a point in the central position of the fourth reservoir plate 63 corresponding to a position where ink will be sunk from the ink sink hole 93. Accordingly, as shown in FIG. 9, the ink flowing into the ink reservoir 3*c* through the ink sink hole 93 branches into two main channels 98 at the central portion of the ink reservoir portion 3*c*. The main channels 98 extend toward the two end portions of the ink reservoir 3*c* formed near the opposite end portions in the main scanning direction, respectively. Further, the two main channels 98 branch into eight branch channels 99 extending toward end portions formed in the opposite end portions in the width direction of the plate, respectively.

Long-hole-like ink outflow holes 105 forming the ink outflow channels 3*d* for making the ink in the ink reservoir 3*c* flow out to the manifold 5*a* are provided in the seventh reservoir plate 66. As the ink outflow holes 105, five holes are formed in each width-direction side of the seventh reservoir plate 66 so as to be aligned in the main scanning direction in positions where the ink outflow holes 105 overlap the opening portions 5*b* (see FIG. 3) of the manifold 5 in plan view.

The ink supply channel 67 is formed from the ink inlet 3*a* to the manifold 5 through the internal channel of the filter mounting hole 90, the ink sink channel 69, the ink sink hole 93, the ink pass 97, the ink pass hole 100*a*, the ink reservoir 3*c* (first space 101) and the ink outflow channels 3*d*. Further, ink is supplied from the ink supply channel 67 to the individual ink channels 32 through the manifold 5 of the channel unit 4.

In the inkjet head 1 described above, the flexible film 100 is provided between the fifth and sixth reservoir plates 64 and 65 which are laminated to each other so as to form the ink reservoir 3*c*. By the flexible film 100, the ink reservoir 3*c* is partitioned into the first space 101 to be filled with ink and the second space 102 to be filled with no ink. Accordingly, the flexible film 100 disposed between the first space 101 and the second space 102 can be deformed by the second space 102 filled with no ink. Thus, the fluctuation of ink pressure occurring in the first space 101 can be absorbed surely by the deformation of the flexible film 100. Thus, the deterioration of accuracy in ink ejection from the nozzles 8 due to the fluctuation of ink pressure can be suppressed to the utmost. In addition, as shown in FIG. 9, the ink reservoir 3*c* occupies a considerably wide area of the whole area of each reservoir plate. Thus, the pressure fluctuation absorbing effect of the flexible film 100 provided in the ink reservoir 3*c* becomes very high. Further, since the flexible film 100 is not exposed to the outside, the flexible film 100 is hardly damaged even when external impact or the like acts on the reservoir unit 71 for some reason.

The ink pass hole 100*a* forming a part of the ink supply channel 67 is formed in a region of the flexible film 100 opposed to the first space 101. Accordingly, the ink flowing through the ink supply channel 67 penetrates the flexible film 100 in the ink pass hole 100*a* and flows into the ink reservoir 3*a* (first space 101). Thus, the two-dimensional size of the reservoir unit 71 can be made smaller than that in the case where ink flows into the ink reservoir 3*c* from a direction parallel to the planes of the laminated plates without penetrating the flexible film 100.

Next, description will be made about modifications in which various changes have been added to the aforementioned embodiment. Incidentally, parts having configurations similar to those in the embodiment are denoted by the same reference numerals correspondingly, and description thereof will be omitted accordingly.

Figure 10A:
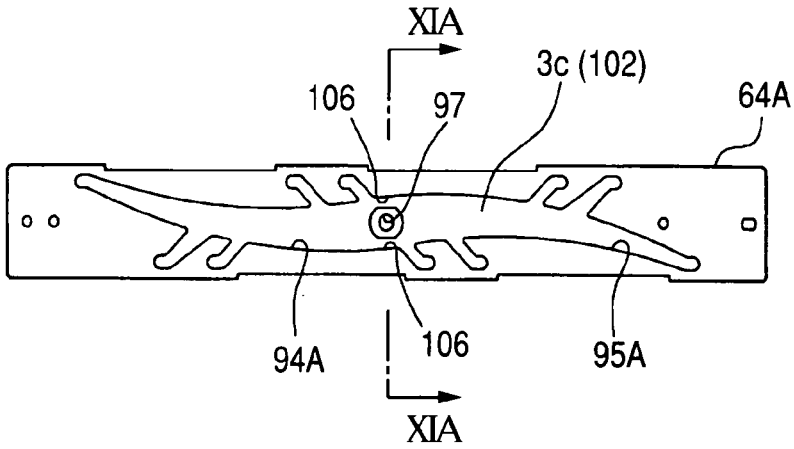
FIG. 10A is a plan view of a fifth reservoir plate according to a modification of the embodiment.
Figure 10B:
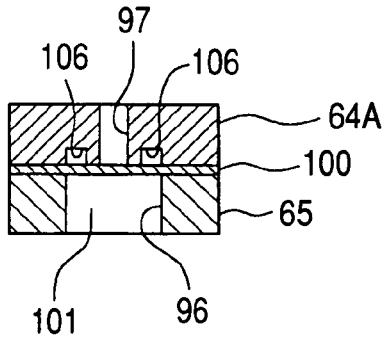
FIG. 10B is a sectional view taken on line XIA-XIA in FIG. 10A.

1] Although the two reservoir holes 94 and 95 (see. FIG. 8) forming the second space 102 are separated from each other so as not to communicate with each other in the aforementioned embodiment, the two reservoir holes maybe made to communication with each other. For example, as shown in FIGS. 10A and 10B, in a fifth reservoir plate 64A, two reservoir holes 94A and 95A may be made to communicate with each other through two recess portions 106 formed in portions of regions separated from the ink pass hole 97 and opposed to the first space 101. In this case, of the flexible film 100, portions opposed to the two reservoir holes 94A and 95A can be vibrated integrally. It is therefore possible to absorb the fluctuation of ink pressure in the ink reservoir 3*c* (first space 101) more efficiently. In addition, the two recess portions 106 are formed in regions separated from the ink pass hole 97 so as not to communicate with the ink pass hole 97. Accordingly, there is no fear that ink flows into the second space 102 formed by the two reservoir holes 94A and 94A and the recess portions 106.

Figure 11:
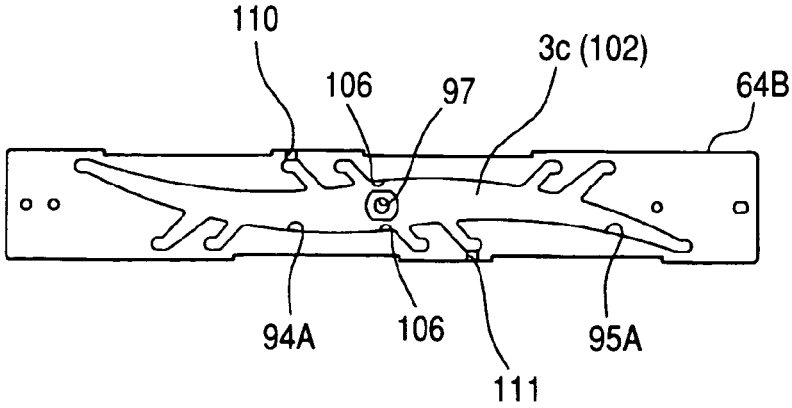
FIG. 11 is a plan view of a fifth reservoir plate according to another modification.

Further, the second space 102 may be made to communicate with the external atmosphere. For example, as shown in FIG. 11, two atmosphere communication holes 110 and 111 maybe formed in a fifth reservoir plate 64B so as to penetrate the fifth reservoir plate 64B continuously from the reservoir holes 94A and 95A to the circumferential edge of the fifth reservoir plate 64B respectively. Thus, the second space 102 communicates with the outside from a side face of the reservoir plate 64B through the two atmosphere communication holes 110 and 111. In this case, the flexible film 100 is hardly affected by the internal pressure of the air in the second space 102. Thus, the degree of freedom in vibrating the flexible film 100 is improved so that the fluctuation of ink pressure can be absorbed more efficiently. The atmosphere communication holes 110 and 111 are not limited to those which are shaped into through holes. For example, they may be formed into concave shapes in the fifth reservoir plate 64B.

2] The material of the flexible film 100 is not limited to synthetic resin. For example, various materials such as synthetic rubber or a very thin metal sheet may be used if they have flexibility.

3] The number of plates forming the ink reservoir 3*c* is not limited to four in the aforementioned embodiment. For example, the first space 101 or the second space 102 may be formed out of a plurality of plates. The number of plates forming the ink reservoir 3*c* can be changed suitably in accordance with the conditions including the size of the ink reservoir 3*c* or the like.

What is claimed is:

1. An inkjet head comprising:

a channel unit including;

a common ink chamber extending in a plane; and a plurality of individual ink channels extending from the common ink chamber to nozzles through pressure chambers respectively; and a reservoir unit configured by a plurality of laminated plates that define a plurality of spaces separate from the channel unit and the common ink chamber of the channel unit, the reservoir unit being fixed to the channel unit and including;

an ink inlet that takes in ink supplied from outside;

an ink reservoir having a first space to be filled with ink and a second space to be filled with no ink;

an ink supply channel that provides ink to the common ink chamber from the ink reservoir; and a flexible film provided between adjacent two plates of the laminated plates, that partitions the ink reservoir into the first space and the second space, wherein the flexible film absorbs fluctuations of pressure of the ink in the ink including at least fluctuations of pressure from ink supplied at the ink inlet.

2. The inkjet head according to claim 1, wherein the flexible film has a first ink pass hole that is provided in a region of the flexible film opposed to the first space, and the first ink pass hole communicates the first space to the ink supply channel.

3. The inkjet head according to claim 2, wherein one of the two plates has a first space formation hole that forms the first space of the ink reservoir, the other of the two plates has a second space formation hole that forms the second space of the ink reservoir, and a second ink pass hole that is provided in a region opposed to the first space and separated from the second space formation hole, and the second ink pass hole communicates the first space to the ink supply channel through the first ink pass hole.

4. The inkjet head according to claim 3, wherein the other of the two plates has a plurality of second space formation holes on the surfaces, and the second ink pass hole is formed in the region between the two second space formation holes.

5. The inkjet head according to claim 4, wherein the other of the two plates further includes a recess portion formed in a region opposed to the first space, the recess portion makes the second space formation holes communicative with each other.

6. The inkjet head according to claim 3, wherein the ink reservoir further includes an atmosphere communication hole that makes communication between the second space formation hole and an outside of the reservoir unit.

7. The inkjet head according to claim 3, wherein the first ink pass hole is formed in a center of the flexible film, and the second ink pass hole is formed in a surface, that faces the flexible film, of the other of two plates.

8. The inkjet head according to claim 1, wherein the second space is provided on an upper side of the first space.

9. The inkjet head according to claim 1, wherein the first space of the ink reservoir and the second space of the ink reservoir substantially have a same size in a cross section, when viewed from a laminated direction of the plates.

10. The inkjet head according to claim 6, wherein the atmosphere communication hole is provided with the other of two plates, and the atmosphere communication hole communicates with outside from a side face of the reservoir unit.

* * * * *